United States Patent [19]

Waarlé

[11] 4,367,384

[45] Jan. 4, 1983

[54] PUSH-BUTTON SWITCH

[75] Inventor: Godfried H. Waarlé, Hilversum, Netherlands

[73] Assignee: U.S. Philips Corporation, New York, N.Y.

[21] Appl. No.: 186,873

[22] Filed: Sep. 12, 1980

[30] Foreign Application Priority Data

Sep. 18, 1979 [NL] Netherlands ..... 7906931

[51] Int. Cl.[3] ..... H01H 13/00; H01H 3/12

[52] U.S. Cl. ..... 200/159 B; 200/159 R; 200/340; 200/159 A

[58] Field of Search ..... 200/159 R, 159 A, 159 B, 200/314, 340

[56] References Cited

U.S. PATENT DOCUMENTS

| | | | |
|---|---|---|---|
| Re. 30,435 | 11/1980 | Fukao | 200/159 R |
| 3,309,487 | 3/1967 | Fisher | 200/340 |
| 3,663,780 | 5/1972 | Golbeck | 200/314 |
| 3,829,646 | 8/1974 | Lorteije et al. | 200/34 D X |
| 3,924,090 | 12/1975 | Chao et al. | 200/159 A |
| 4,227,163 | 10/1980 | Barnowski | 200/159 R X |

FOREIGN PATENT DOCUMENTS

| | | | |
|---|---|---|---|
| 229425 | 7/1960 | Australia | 200/159 R |
| 266970 | 12/1968 | Austria | 200/340 |
| 2337904 | 2/1974 | Fed. Rep. of Germany | 200/159 R |
| 1169029 | 7/1960 | France | 200/159 R |
| 1219022 | 1/1971 | United Kingdom . | |

*Primary Examiner*—William Price
*Assistant Examiner*—Gary E. Elkins
*Attorney, Agent, or Firm*—Robert J. Kraus

[57] ABSTRACT

A push-button switch comprising a slidable member (7) which is longitudinally displaceable by means of a control member (1) and which operates a contact device (29). The slidable member (7) comprises four guide members (21, 23, 25, 27) which are guided in channels of a support (41) which is arranged between the control member (1) and the contact device (29).

2 Claims, 3 Drawing Figures

PUSH-BUTTON SWITCH

BACKGROUND OF THE INVENTION

The invention relates to a push-button switch comprising a slidable member which is displaceable by means of a control member and which is made of a synthetic resin material. The sliding member operates a contact device and comprises a cruciform head which is provided on an end of the slidable member facing the control member and which is secured in a cruciform socket in the control member by a projection on one member engaging in a recess in the other member. The slidable member comprises two flexible elongate guide members which are slidable in two guide channels in a support for the slidable member. The guide channels are arranged with their open sides facing each other, and the guide members include projections which cooperate with abutments on the support.

In a push-button switch of the above-described kind, which is known from British Patent Specification 1,219,022, each of two flexible guide members which are situated in the same plane comprises a projection which cooperates with a corresponding abutment in the support. The diametrically oppositely situated abutments in the support are formed by the end walls of openings provided in the wall of the support. For mounting the slidable member in the support, the guide members must be deflected towards each other, after which the slidable member can be inserted into the guide channels of the support and can subsequently be hooked into the openings by way of its projections.

In order to prevent undesirable rotation of the control member and the slidable member, the distance between the guide elements must be comparatively large in the known push-button switch, while the thickness of the flexible guide members (viewed transversely of the plane of the two guide members) should be as accurate as possible. The latter requirement can be simply satisfied, because the thickness of the guide legs is only comparatively small. However, it is very difficult to satisfy the former requirement, because the comparatively large distance between the bottoms of the two guide channels necessarily entails a larger dimensional deviation. Obviously, this is also applicable to the bearing faces of the guide members. Consequently, the guide members will always slide along a connecting line between the guide channels.

In the known push-button switch, removal of the slidable member is impossible without dismantling the entire switch. This is because in the assembled condition the guide members can be moved towards each other only from the lower side in order to release the projections on the guide members from the openings in the support.

SUMMARY OF THE INVENTION

It is an object of the invention to mitigate the described drawbacks and to provide a push-button switch in which on the one hand any relative movement in directions other than that of the contact movement between the slidable member and the support is minimized, while on the other hand the slidable member can be readily removed.

To this end, a push-button switch is characterized in that the sliding member comprises two rigid guide members which are slidable in two further guide channels in said support, which further guide channels are arranged with their open sides facing each other and, in conjunction with the first two guide channels, prevent displacement of the slidable member transversely of its sliding direction, the flexible guide members each being connected, adjacent an end thereof which faces the contact device, to a body portion of the slidable member, while their other ends are located in a recess in the control member.

Because the thickness of each of the four guide members (viewed transversely of the planes containing the respective pairs of guide members) can exhibit only an extremely small dimensional deviation, each pair of oppositely situated guide members prevents a relative shift of the slidable member with respect to the support in a direction transversely of the plane of this pair of guide members. Actually, the distance between the two guide channels can be made as large as desired, because the comparatively large dimensional deviation of this distance no longer has an effect on any displacements along the connecting line between two oppositely situated guide channels.

In a special embodiment of a push-button switch in accordance with the invention, three of the guide channels receive the corresponding guide members of the slidable member with a close fit, while there is play between the fourth guide member and the walls of the corresponding fourth guide channel.

An embodiment of this kind offers the advantage that any dimensional inaccuracy of the fourth guide channel and/or the fourth guide member cannot lead to clamping of the slidable member in the support. The accurate guiding of the slidable member in the support is adequately ensured by the other three guide channels and guide members.

BRIEF DESCRIPTION OF THE DRAWING

The invention will be described in detail hereinafter with reference to the accompanying diagrammatic drawing in which.

DESCRIPTION OF THE PREFERRED EMBODIMENT

Figure 1:
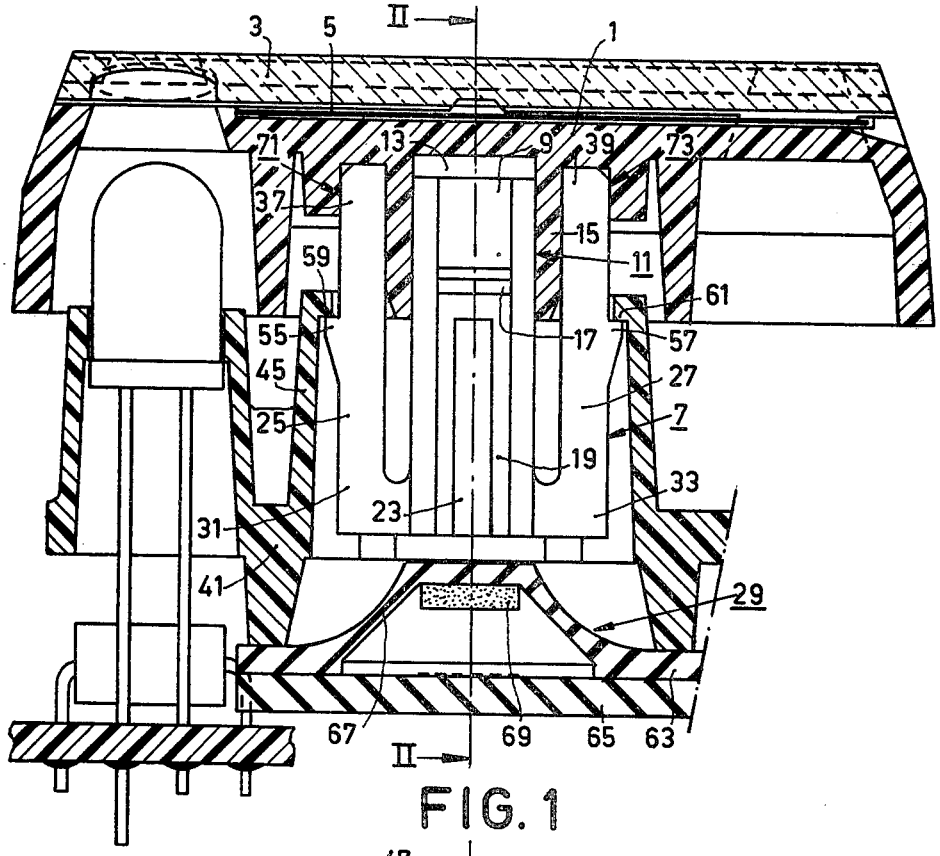
FIG. 1 is a longitudinal sectional view of a preferred embodiment of a push-button switch in accordance with the invention, taken along the line I—I in FIG. 2 and with the slidable member shown in full elevation.
Figure 3:
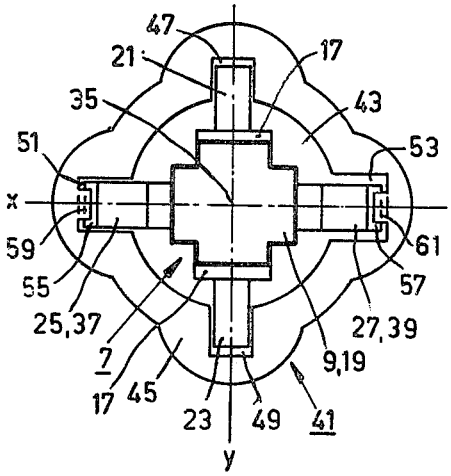
FIG. 3 is a plan view of the push-button switch shown in FIGS. 1 and 2 but with the control member removed.
Figure 2:
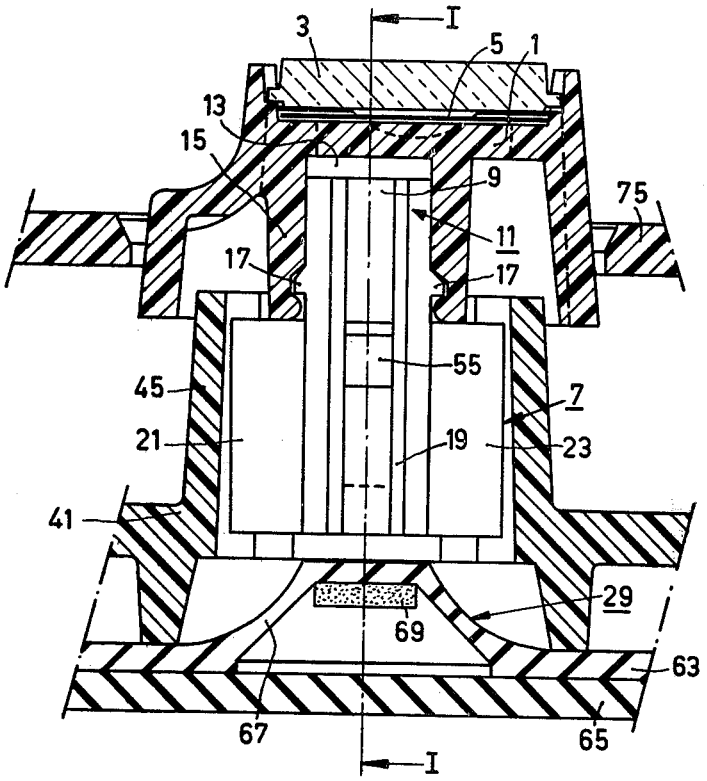
FIG. 2 is a cross-sectional view taken along the line II—II in FIG. 1 again with the slidable member shown in full elevation.

The push-button switch shown in FIGS. 1 and 2 comprises a rectangular control member 1 which is moulded in a synthetic resin material. Preference is given to an acrylonitrile-butadiene-styrene combination with a glass filler. In the control member 1 there is arranged a transparent plate 3. Underneath this plate there is provided a strip 5 bearing verbal or other graphical information. The control member 1 is mounted on a slidable member 7 which is moulded in one piece. The slidable member 7 is preferably made of glass-filled nylon. It has a cruciform head 9 which is outlined in FIG. 3 by a comparatively heavy line. The control member has a cruciform recess 11 (the cross shape is not shown) which serves as a socket to receive the head 9. The head 9 fits in the recess 11 with a slight clamping fit. In the assembled condition, a clearance 13 remains between the head 9 and the upper wall of the recess 11. The recess 11 is bounded by a wall 15 which has recesses engaged by projections 17 on the head 9. The wall 15 is constructed to be slightly flexible at the area of the recesses for the projections 14 to permit entry of the projections into these recesses. Moreover, the materials of the control member 1 and the sliding member 7 are slightly compressible.

The cruciform head 9 forms the upper part of an elongate body 19 of cruciform cross-section in the present embodiment. However, the body 19 need not have a cruciform cross-section over its full height. The part of the slidable member 7 which is situated below the head 9 comprises a pair of rigid guide members 21 and 23 and a pair of flexible elongate guide members 25 and 27. The rigid guide members 21 and 23 are plate-shaped and are situated one opposite the other. The flexible guide members 25 and 27 are bar-shaped with a rectangular cross-section and are also situated one opposite the other. The slidable member 7 is symmetrical about a plane X and about a plane Y (see FIG. 3), both planes containing the central longitudinal axis 35 of the slidable member 7. The guide members 21, 23, 25 and 27 actually make the cross-shape of the lower part of the body 19 more pronounced. The guide members 25 and 27 are connected to the body 19 adjacent their lower ends 31, 33 respectively, which ends face a contact device 29, and they extend parallel to the central axis 35 (see FIG. 3) of the slidable member 7. In the dismantled condition of the slidable member 7, the guide members 25 and 27 comprise free distal ends 37 and 39. Because each of the guide members 25 and 27 is connected to the body 19 adjacent only one end 31, 33, respectively, and because they have a comparatively long length, they are flexible. The guide members 21 and 23 are connected to the body 19 over their entire length, so that they behave as comparatively rigid guide plates. On the contact device 29, yet to be described, there is mounted a support 41 of a synthetic resin material for the member 7. The support comprises an open-ended hollow body 43 of generally cylindrical form. The support 41 is preferably made of glass-filled polycarbonate. In the wall 45 of the body 43 there are provided two guide channels 47 and 49 of U-shaped cross-section whose open sides face each other and which slidably receive the guide members 21 and 23, respectively, and two guide channels 51 and 53 of U-shaped cross-section whose open sides face each other and which slidably receive the guide members 25 and 27, respectively (see FIG. 3). The flexible guide members 25 and 27 comprise projections 55 and 57, respectively, which co-operate with abutments 59 and 61 (see FIG. 1) formed on the support 41. During the mounting of the slidable member 7 in the support 41, the flexible guide members 25 and 27 are pressed towards each other sufficiently to allow the projections 55 and 57 to pass the abutments 59 and 61, and the four guide members are slid into the corresponding guide channels of the support 41. The projections 55 and 57 are retained against the abutments 59 and 61 by the spring force of a rubber strip 63 which forms part of the contact device 29. The rubber strip 63 is supported on a rigid plate 65 of an electrically insulating material, on which plate electrically conductive tracks are provided; these tracks have to be bridged by an electrically conductive material to effect switching. This material is provided on the lower side of a mesa-like raised portion 67 of the rubber strip 63 and is formed as a round plate 69 of an electrically conductive rubber which is connected to the rubber strip 63. After mounting the slidable member 7 in the support 41, the control member 1 is mounted on the slidable member.

To this end, the control member comprises not only the recess 11 for the cruciform head 9 of the slidable member, but also two rectangular recesses 71 and 73 which receive the distal ends 37 and 39 of the flexible guide members 25 and 27 with an accurate fit. The ends 37 and 39 abut against the upper walls of the recesses 71 and 73, which thus determine the position of the control member 1 and the slidable member 7 relative to each other. After the mounting of the control member, the guide members 25 and 27 no longer exist as flexible bars but constitute comparatively rigid members which make an essential contribution to the accurate guiding of the slidable member 7 in the support 41.

In the described preferred embodiment of the support 41, three of the four guide channels in the support and the three corresponding guide members on the slidable member 7 are made with very close dimensional tolerances. In the present case, these are the guide channels 49, 51 and 47 and the guide members 23, 25 and 21 (see FIG. 3). Accurate positioning of the slidable member in the lateral direction is thus fully ensured, because diametrical horizontal displacements of the slidable member 7 with respect to the support 41 transversely of the direction of the slidable movement of the sliding member are substantially impossible. The length of the guide channels and the guide members is, obviously, so chosen that tilting of the slidable member is also prevented. The width of the guide channel 53 is deliberately chosen so that the guide member 27 is accommodated with substantial play in the trough 53. Obviously, all the guide channels and guide members can alternatively be manufactured with the same high precision, although this increases cost.

It will be clear that the described push-button switch can be easily dismantled from the top. This is particularly important for "key-boards" comprising a plurality of push-buttons of the described kind. In that case the plate 65 carries a plurality of conductive tracks to be bridged. The rubber strip 63 then comprises a plurality of mesa-like raised portions 67, each carrying its own contact plate 69, and a corresponding plurality of supports similar to the support 41 is provided in the form of a single moulding. For coarse positioning of the control members, use is made of a positioning plate such as the plate 75 in FIG. 2.

Push-button switches according to the invention can utilize all types of contact devices in which contact is established by way of movement of the control member. Contact devices comprising strip-shaped contact elements, however, offer the advantage of a comparatively small height.

What is claimed is:

1. A push-button switch comprising:

(a) a contact device including electrical contacts which are movable relative to each other;

(b) a body attached to the contact device, said body including two pairs of elongate channels centered on respective planes which intersect at a longitudinal axis of the body;

(c) a slidable member having a head on one end and including a pair of rigid guide members and a pair of flexible guide members for engaging the respective pairs of elongate channels to slidably support the member for movement relative to the contact device, said body and said flexible guide members having cooperating abutments and projections for retaining the flexible guide members in their respective channels; and (d) a control member having a socket for engaging the head of the slidable member, said control member and said rigid guide members having cooperating projections and recesses for securing the control member to the slidable member, said control member serving as a means for displacing the slidable member and thereby actuating the electrical contacts in the contact device.

2. A push-button switch as in claim 1, characterized in that one of the guide members fits loosely in its respective channel with respect to the fit of the other guide members in their respective channels.

* * * * *